US006886541B2

(12) United States Patent
Powell

(10) Patent No.: US 6,886,541 B2
(45) Date of Patent: May 3, 2005

(54) FUEL PUMP MODULE AND METHOD OF ASSEMBLY

(75) Inventor: Patrick Powell, Southfield, MI (US)

(73) Assignee: Denso International America, Inc., Southfield, MI (US)

( * ) Notice: Subject to any disclaimer, the term of this patent is extended or adjusted under 35 U.S.C. 154(b) by 155 days.

(21) Appl. No.: 10/374,792

(22) Filed: Feb. 25, 2003

(65) Prior Publication Data

US 2004/0163630 A1 Aug. 26, 2004

(51) Int. Cl.[7] ..... F02M 37/04
(52) U.S. Cl. ..... 123/509; 417/360
(58) Field of Search ..... 123/509, 514, 123/518, 198 D; 417/360

(56) References Cited

U.S. PATENT DOCUMENTS 4,178,894 A * 12/1979 Nau ..... 123/572
4,211,201 A 7/1980 Sumiyoshi et al.
4,926,829 A 5/1990 Tuckey
5,070,849 A 12/1991 Rich et al.
5,080,077 A 1/1992 Sawert et al.
5,330,475 A 7/1994 Woodward et al.
5,415,146 A 5/1995 Tuckey
5,427,074 A 6/1995 Tuckey
5,454,697 A * 10/1995 Nakanishi ..... 417/423.3
5,469,829 A 11/1995 Kleppner et al.
5,511,957 A 4/1996 Tuckey et al.
5,522,425 A * 6/1996 Kroiss et al. ..... 137/590
5,527,163 A 6/1996 Werkmann et al.
5,564,397 A 10/1996 Kleppner et al.
5,647,330 A 7/1997 Sawert et al.
5,669,359 A * 9/1997 Kleppner et al. ..... 123/509
5,699,773 A 12/1997 Kleppner et al.
5,762,049 A 6/1998 Jones et al.
5,797,373 A 8/1998 Kleppner et al.
5,797,377 A 8/1998 Fischerkeller
5,960,775 A 10/1999 Tuckey
5,979,485 A 11/1999 Tuckey et al.
6,000,913 A * 12/1999 Chung et al. ..... 417/53
6,012,904 A 1/2000 Tuckey
6,113,354 A 9/2000 Meese et al.
6,155,793 A 12/2000 Tuckey et al.
6,206,037 B1 3/2001 Murakoshi et al.
6,213,726 B1 4/2001 Tuckey
6,230,691 B1 5/2001 Coha et al.
6,260,543 B1 7/2001 Chih
6,276,342 B1 8/2001 Sinz et al.
6,293,256 B1 9/2001 Kleppner et al.
6,308,733 B2 10/2001 Murakoshi et al.
6,401,751 B2 6/2002 Murakoshi et al.
6,435,163 B1 * 8/2002 Fauser et al. ..... 123/509
6,604,511 B2 * 8/2003 Hazama ..... 123/509
2001/0047827 A1 12/2001 Murakoshi et al.
2001/0050107 A1 12/2001 Walter
2002/0074270 A1 6/2002 Fisherkeller et al.
2002/0119056 A1 8/2002 Appleton et al.
2003/0106537 A1 * 6/2003 Isozaki et al. ..... 123/509

* cited by examiner

*Primary Examiner*—Mahmoud Gimie
(74) *Attorney, Agent, or Firm*—Harness, Dickey & Pierce, PLC

(57) ABSTRACT

A fuel pump module and method for mounting such to a fuel tank having a limited mounting depth, includes a reservoir, a modular flange, and a compressible coupling element, wherein the modular flange and the reservoir containing the fuel pump are connected offset to each other vertically, by means of the compressible coupling element. Upon installation in a shallow fuel tank, the offset attachment provides for the reservoir, to be biased against the bottom wall of the fuel tank without vertically interfering with the modular flange embodying various components such as vent valves or carbon canisters, which after mounting, are at least partially adjacent horizontally to the reservoir within the fuel tank.

10 Claims, 3 Drawing Sheets

FUEL PUMP MODULE AND METHOD OF ASSEMBLY

FIELD OF THE INVENTION

The present invention relates to fuel delivery systems mounted to a fuel tank. Specifically, the invention relates to a fuel pump module having a reservoir portion within the fuel tank, for utilization in shallow fuel tank mounting applications.

BACKGROUND OF THE INVENTION

Fuel tanks utilized for holding a supply of fuel for vehicles utilizing an internal combustion engine, are often limited in their volume and dimensions by the available space within a given area on a vehicle designated for such a purpose. With the increasing trend towards manufacturing smaller, more efficient vehicles, the available space for mounting fuel tank becomes even more limited in any given application. Due to these spatial restrictions, often times the fuel tank is specifically shaped to have a broad flat design with relatively shallow depth. These dimensions limit the mounting depth available for installing a fuel pump module having various components attached there to, for example vent valves, or emission reduction canisters, required by increasing regulations for emissions.

The alternative to having these components incorporated with the fuel pump module would be to locate them in separate apertures in the fuel tank. Unfortunately though, each additional hole increases potential fuel emission sources. Therefore it is advantageous to have a fuel pump module incorporating the sending unit, pump motor, vents, and other components into a single unitary element, reducing the need for multiple apertures through the wall of a fuel tank, and thereby limiting sources of emissions.

Fuel pump modules have been designed for a wide variety of fuel delivery applications, and have greatly improved how fuel is delivered to the engine of a vehicle. Certain pump modules utilize a reservoir as part of the fuel sending unit, as disclosed in U.S. Pat. No. 5,452,701 to Tuckey. Positioned within the fuel tank for providing a constant supply of fuel to the engine of the vehicle, these reservoirs are fed by a supply of fuel from the tank by means of a jet pump, incorporated into the main fuel pump of the sending unit.

The jet pump works to deliver fuel to the reservoir from the tank by way of a vacuum force, created by a portion of the pressurized fuel from the output of the primary fuel pump being directed through the jet pump creating a pressure gradient drawing fuel in from the tank to the reservoir. In order to maximize the efficiency of a large volume fuel tank, the jet pump and the reservoir need to be positioned adjacent the bottom or lowest portion of the fuel tank, so as to allow fuel delivery to the primary pump even in low tank fuel level situations. The problem is such, that in shallow mounting depth applications of fuel tanks, where the reservoir of the fuel pump module is directly below the modular flange, physical interference occurs between the reservoir and the components attached to the bottom of the pump modular flange.

One solution, as taught by U.S. Pat. No. 6,308,733 issued to Murakoshi, et al. is to provide for a means allowing the fuel pump reservoir to pivot away from the pump mounting flange when the unit is installed on a fuel tank. This is achieved by attaching the reservoir to the modular flange by means of a pivotal connection, thereby allowing the reservoir to deflect away horizontally from the modular flange during insertion of the pump module through the aperture located in the upper wall of a fuel tank. This provides the necessary mounting depth to fully lower the modular flange into the aperture and seal off the tank without interfering with the reservoir. Unfortunately, this pivotal joint may at times allow the reservoir to levitate off the bottom of the fuel tank even after installation, depending on how rough the conditions are of the terrain the vehicle is driving over, in turn, causing possible fuel starvation to the pump, or increased wear and eventually failure of the pivotal connection, requiring service or replacement.

The present invention overcomes the aforementioned shortcomings of prior art in utilizing compatible components of prior art fuel pump modules, to provide a modular flange and a reservoir attached offset thereto. The invention allows for the vertical insertion of the reservoir and fuel pump through the fuel tank aperture, subsequently followed by sliding of the module horizontally relative to the fuel tank so as to align the modular flange with the fuel tank aperture for attachment thereto, offset from the internal reservoir. This design significantly increases the space available for mounting extra components to the backside of the modular flange necessary to reduce emissions, while preserving the function of the fuel pump module without interference of the fuel pump reservoir.

SUMMARY OF THE INVENTION

It is therefore an object of the present invention to provide for a means for installing a fuel pump module utilizing a reservoir, which can be utilized in fuel tank applications having limited vertical mounting depth.

It is another object of the present invention to provide for a fuel pump module which can accommodate the increasingly necessary components such as vent valves and carbon canisters to be added to the backside of the modular flange of the module, while still preserving the function of the module.

A further object of the present invention is to provide a means of attaching the fuel reservoir offset from the modular flange, so as to provide the adequate vertical mounting depth in a shallow fuel tank application.

Another object of the present invention is to provide a fuel pump module comprising numerous components compatible with other fuel pump modules.

The foregoing objects are achieved by a fuel pump module for providing a vehicle with a supply of fuel, comprising a modular flange, pump reservoir and one or more attachment means connecting the two elements together. In addition to the fuel pump outlet and return fittings, located on the modular flange, various optional components are attached to the bottom side such as vent valves, or carbon canisters. The inlet of the primary fuel pump, located within the reservoir is fed with fuel supplied from the reservoir of the pump module, which in turn receives fuel from adjacent the reservoir, proximate the bottom of the main fuel tank by means of a jet pump, having an inlet located outside the reservoir, proximate the bottom of the gas tank, and an outlet inside the reservoir. The reservoir is attached to the flange offset from the center by attachment means comprising one or more spring-biased struts, which act to abut the reservoir against the bottom of the fuel tank after installation.

With the entire module preassembled, installation in a fuel tank is achieved by lowering the reservoir into the tank through the aperture located in the upper wall there of, and subsequently sliding the unit horizontally relative to the fuel tank, until the flange is centered over the fuel tank aperture. The flange is then pressed down into position, compressing the struts until the flange is seated fully over the aperture, sealing the fuel tank. With the reservoir offset from the flange, components attached to the bottom side of the flange have an adequate mounting depth without interference of the reservoir, which is now located aside the flange within the fuel tank.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
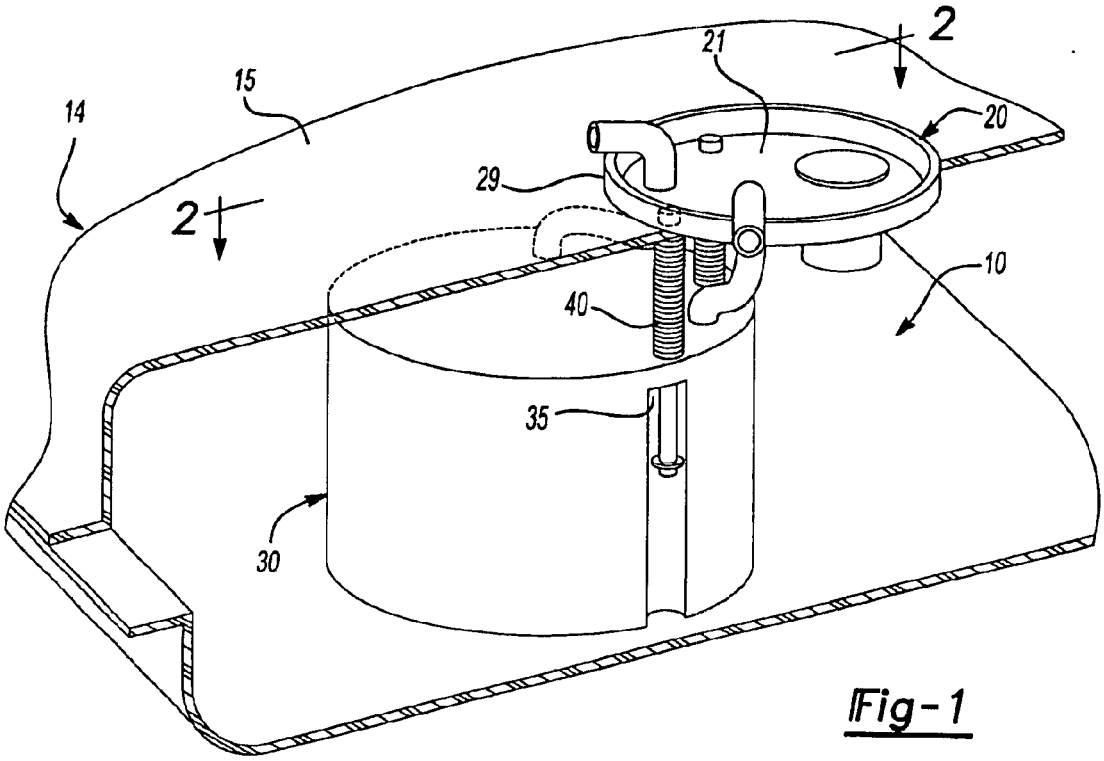
FIG. 1 is a prospective view of the fuel pump module, mounted in a fuel tank sectioned along the modular aperture of the pump module.
Figure 2:
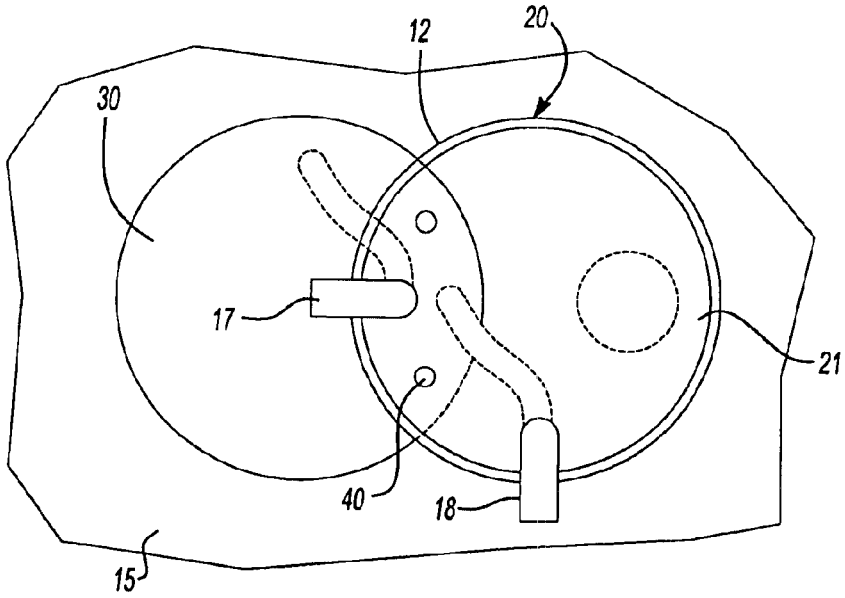
FIG. 2 is an aerial, phantom view of the fuel tank module as mounted in a fuel tank taken along the line 2 of FIG. 1.

Referring to the drawings, and particularly FIGS. 1 and 2, there is shown the fuel pump module of the present invention 10 as mounted to a fuel tank 14. Specifically, the module is mounted within an aperture 12 located through the upper wall 15 of the fuel tank 14, wherein upon installation, virtually all components are located within the inside volume area of the fuel tank 14, with the exception of fuel inlet 17 and return 18 fittings, as well as any other necessary vents and electrical connectors not illustrated. The module 10 is generally comprised of two main elements; a modular flange 20 and a pump reservoir 30, which are interconnected by attachment means 40 and various interior fuel lines or wires, generally illustrated as numeral 41, a number of which are omitted for clarification of illustrating the gist of the present invention. The entire fuel pump module 10 is preassembled prior to installation in a fuel tank 14, providing for the unitary insertion through the aperture 12, and subsequent attachment of the modular flange 20 to the fuel tank 14.

The first element, the modular flange 20, is of a general disk shape, having an outer, top surface 21 and an inner, bottom surface 22 for mounting through an aperture 12 in the upper wall 15 of a vehicle fuel tank 14 so as to seal off the inside volume of the fuel tank with the outside atmosphere. Once fully installed and attached to the fuel tank 14, the top surface 21 of the modular flange 20 will be exposed only to the outside atmosphere, whereas the bottom surface 22 of the flange 20 will be limited to exposure inside the fuel tank 14.

The modular flange 20 further comprises a sealing means, not illustrated or relevant to the claim of the present invention, positioned around the perimeter of the flange 20 for sealing the flange 20 to the upper wall 15 of the tank 14 when mounted there through aperture 12. In addition to the fuel pump inlet 17 and return 18 fittings attached and incorporated within the modular flange 20, additional components necessary to the fuel system such as vent valves, carbon canisters, etc. are also included attached thereto. The specificity of these additional components can vary from application to application, but are generally represented in FIGS. 3–6 as numeral 27. These components could be located in alternative apertures through the fuel tank wall separate from the fuel pump module, but incorporating them within the pump modular flange as in the present invention, eliminates the need for additional holes, i.e. potential source for fuel emissions from the fuel tank.

Mounted to the modular flange 20, is the attachment means 40, extending perpendicularly down for interconnecting the modular flange 20 to the reservoir 30. The attachment means 40 are comprised of one or more compression spring struts, mounted off-center at one end to the bottom surface 22 of the modular flange 20, proximal the front edge 29, thereby attaching the reservoir 30 off-set when viewed from the top as in FIG. 2.

The second element, the pump reservoir 30 is a generally round-shaped, enclosed container with at least one cross sectional diameter smaller than the diameter of the aperture 12, allowing for its insertion into the fuel tank 14 there through. The round shape of the reservoir 30 as illustrated in the preferred embodiment, having a slightly smaller diameter than that of the aperture 12 of the fuel tank provides for the direct vertical insertion into the fuel tank 14 through the aperture 12. The reservoir 30 has an internal fuel capacity sufficient enough to supply the main fuel pump with an adequate supply of fuel during temporary moments of fuel depletion such as during off-camber vehicle operation, and is continuously replenished with fuel from the vehicle's fuel tank 14 by means of a jet pump, not shown in the drawings but common in the art. The jet pump is located within the reservoir 30 and operates by means of a vacuum force created through draw of the main fuel pump. During times when the vehicle is cornering or stopping, if there is relatively little fuel in the tank 14, the jet pump may be temporarily starved for fuel. Fortunately the stored fuel inside the reservoir 30 ensures that an adequate amount is available to the fuel pump, until such time the fuel in the tank flows back to the intake of the jet pump after the vehicle has finished its maneuver, thereby preventing the vehicle from stalling.

Figure 5:
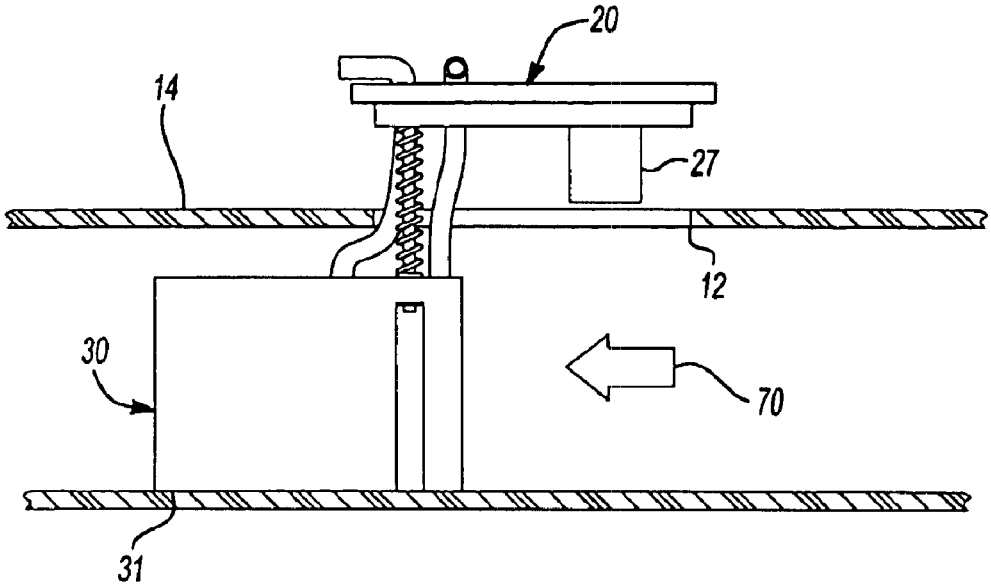
FIG. 5 is a partial-sectional side view of the third step for installing the fuel pump module into a fuel tank, showing the modular flange aligned with the aperture of to the fuel tank.
Figure 6:
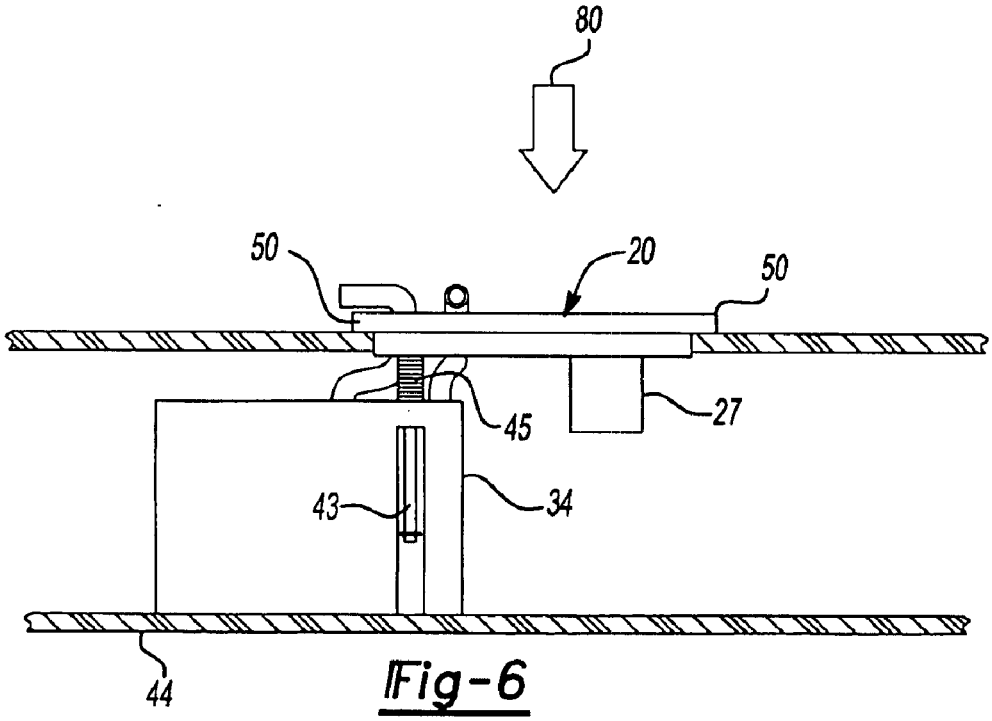
FIG. 6 is a partial-sectional side view of the fourth step for installing the fuel pump module into a fuel tank, showing the modular flange depressed and attached to the fuel tank.

The compression spring struts of the attachment means 40, connect the reservoir 30 to the modular flange 20, offset from the center, in a manner so as to allow vertical articulation between the flange 20 and the reservoir 30 during installation of the module 10. The struts each comprise a shaft 43 with a compression spring 45 coiled around it, and attach at one end to a mounting point 35 located on the reservoir 30, allowing the shaft 43 to slide vertically along the side of the reservoir 30 without interference when the springs 45 are compressed as shown in FIG. 6. Once the module 10 is fully installed within the fuel tank 14, the compressed spring struts of the attachment means 40 provide for a downward force upon the reservoir 30, abutting the reservoir 30 adjacent the inside bottom wall 44 of the fuel tank 14 as shown in FIGS. 5 and 6. It is crucial to have the reservoir 30 biased against the bottom wall 44 of the fuel tank 14, so as to allow the jet pump to draw fuel in from the fuel tank 14 when the overall fuel level is low.

As illustrated in FIGS. 3–6, fuel tanks are often relatively quite shallow, providing minimal room for the vertical mounting of a fuel pump module 10 to a fuel tank 14. Specifically, FIG. 6 illustrates how the fuel pump module 10 within the scope of the present invention, once fully installed on a fuel tank 14 solves this problem, eliminating any vertical interference between components 27 attached to the bottom surface 22 of the modular flange 20, and the back side 34 of the reservoir 30, provided by the offset mounting of the reservoir 30.

Figure 3:
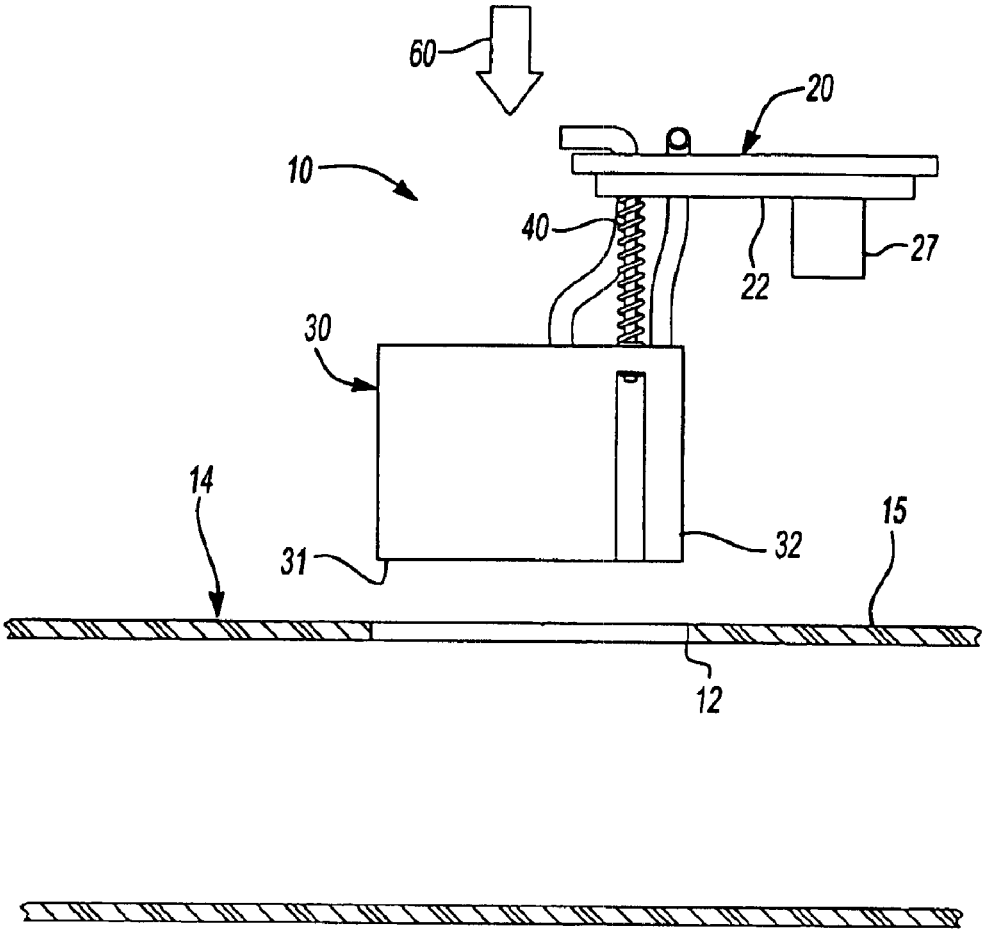
FIG. 3 is a partial-sectional side view of the initial step for installing the fuel pump module into a fuel tank, showing the reservoir partially inserted through the aperture in the fuel tank.
Figure 4:
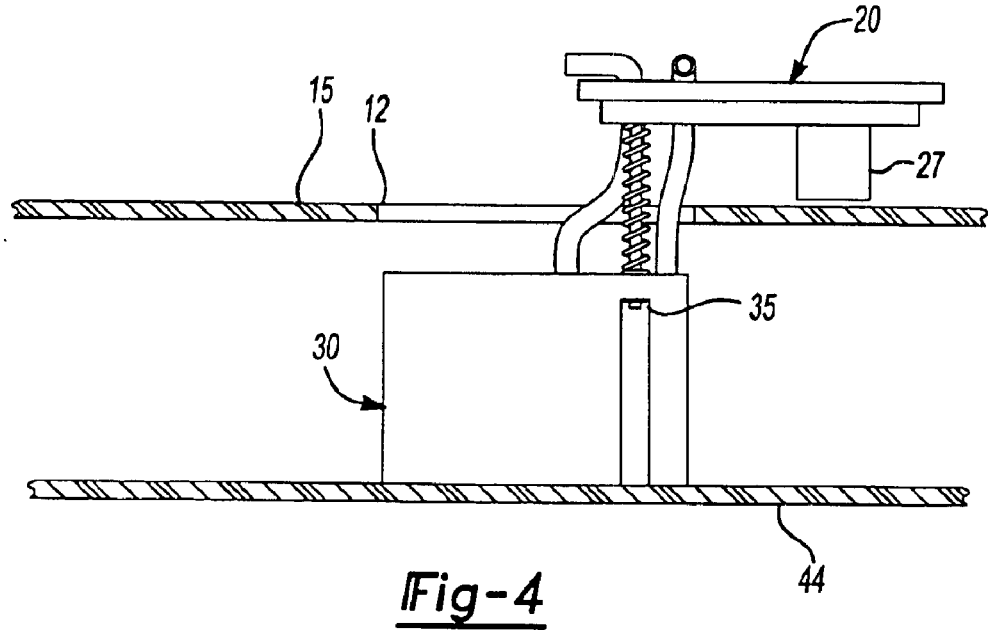
FIG. 4 is a partial-sectional side view of the second step for installing the fuel pump module into a fuel tank, showing the reservoir fully inserted within the fuel tank.

The method of assembling the fuel pump module 10 with a fuel tank 14 is simplified considerably because of its preassembly prior to installation. FIGS. 3–6 illustrate the steps comprising the best mode of attaching the module 10 of the present invention to a fuel tank 14, but are not intended to limit the scope of the present invention. Specifically referring to FIG. 3 illustrating the initial step, there is shown the fuel pump module 10 centered over the aperture 12 in the upper wall 15 of the fuel tank 14, whereby it is subsequently lowered through the aperture 12 as indicated by the arrow numbered 60. The module 10 as shown is aligned upright in relation to the fuel tank 14 allowing for the reservoir 30 to be lowered directly through the aperture 12. Although reservoirs 30 having alternative shapes may be utilized in the module 10, it is the direct vertical decent of the fuel pump reservoir 30 through the aperture 12 which comprises the preferred method of installation allowing for the subsequent direct decent of the modular flange 20 and vents 27 into position. Once fully inserted, the reservoir 30 is horizontally parallel relative to the fuel tank 14, resting flat on the bottom wall 44 as shown in FIG. 4. At this point, the modular flange 20 remains unaligned vertically with the aperture 12 in the upper wall 15 of the tank 14, preventing the attached components 27 from passing through the fuel tank aperture 12.

The next step, illustrated by FIG. 5 consists of sliding the entire pump module 10 horizontally in relation to the fuel tank 14, as shown by the arrow indicated with the numeral 70, until the point where the modular flange 20 is directly aligned with the aperture 12 in the fuel tank 14. The reservoir is now generally positioned away from the aperture 12, providing the necessary room directly below the aperture 12 for the mounting of the modular flange 20 and its components 27.

The final step, as shown by FIG. 6 involves applying downward force to the top surface 21 of the modular flange 20 as indicated by the arrow numbered 80, so as to compress the springs struts 42 enough to lower the modular flange into position sealing the aperture 12 of the tank 14. As illustrated, the flange 20 is prevented from traveling through the aperture 12 due to the modular flange 20 having a larger diameter than that of the aperture 12. Once completely lowered into position, the modular flange 20 is secured by a locking means 50 such as screws or clamps, thereby sealing the internal volume of the fuel tank off from the exterior. As shown, the various components 27 attached to the bottom of the modular flange 20 do not interfere with the reservoir 30, which would otherwise prevent the flange 20 from being fully lowered into position if the reservoir 30 was directly below the modular flange 20.

As previously stated, the description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel pump module for mounting to a fuel tank having a limited mounting depth, comprising:

a modular flange, for sealing and attaching through an aperture in the fuel tank, said flange having a top side, a bottom side, and a vertical center, said modular flange having an accessory component extending from said bottom side and collectively defining a flange mounting height;

a reservoir attached to said modular flange offset from said center, and adapted to be inserted into said fuel tank through said aperture in an upright orientation and maintaining a substantially parallel relationship with a bottom surface of the fuel tank, said reservoir having a height less than the mounting depth of the fuel tank; and a vertically-compressible attachment means operatively connecting said flange to said reservoir;

wherein the sum of said flange mounting height, and said reservoir height defines a fuel pump module height, and is greater than the fuel tank mounting depth.

2. The fuel pump module of claim 1 wherein said accessory component is attached to said bottom side of said modular flange in an offset relationship from said vertically compressible attachment means.

3. The fuel pump module of claim 2 wherein said vertically-compressible attachment means defines an axis intersecting said modular flange and said reservoir in an installed position.

4. The fuel pump module of claim 1 wherein said compressible attachment means comprises at least one spring-biased strut.

5. The fuel pump module of claim 1 wherein said compressible attachment means attaches to one end of said reservoir.

6. The fuel pump module of claim 1 wherein when said vertically-compressible attachment means is compressed, said modular flange is at least partially horizontally adjacent to said reservoir.

7. The fuel pump module of claim 6 wherein when attachment means is compressed, said fuel pump module height is approximately equal to the fuel tank mounting depth.

8. A method of mounting a fuel pump module to a fuel tank having a limited mounting depth and an aperture through an upper wall, said pump module comprising: a modular flange having a top side, a bottom side, a vertical center, said modular flange having an accessory component extending from said bottom side; a reservoir attached to said modular flange offset from said center, having a height less than the mounting depth of the fuel tank; a vertically-compressible attachment means, operatively connecting said flange to said reservoir and defining an axis intersecting said modular flange and said reservoir;

comprising the steps of:

positioning the fuel pump module above the fuel tank whereby said reservoir is positioned substantially upright and in line with the aperture of the fuel tank whereby said reservoir defines an upright outer dimension suitable to be accepted vertically through the aperture;

lowering said fuel pump module towards the fuel tank until said reservoir traverses through the aperture and contacts the bottom wall of the fuel tank, opposite the aperture;

sliding said fuel pump module horizontally relative to an upper surface of the fuel tank, so as to position the fuel pump modular flange directly in line above said aperture, and consequently locate said reservoir inside the fuel tank at an offset relationship with the aperture;

applying downward force to said modular flange, compressing the attachment means of said module until said modular flange closes the aperture in the fuel tank; and attaching the modular flange to the fuel tank.

9. The method of mounting a fuel pump module to a fuel tank in claim 8 wherein the said step for attaching the modular flange to the fuel tank comprises clamping said modular flange to the upper wall of the fuel tank.

10. A fuel pump module for mounting to a fuel tank, comprising:

a modular flange adapted to sealably mate with an aperture defined through a planar surface of the fuel tank;

a reservoir having an upper surface, a lower surface and an outer wall extending between said upper and lower surface, wherein said reservoir is coupled to said modular flange and adapted to be received through said aperture in a substantially upright orientation wherein said lower surface maintains a substantially parallel relationship with said planar surface of the fuel tank;

an accessory component coupled to said modular flange and adapted to extend through said aperture; and a vertically compressible attachment means coupling said reservoir and said modular flange, said vertically-compressible attachment means defining an axis intersecting said reservoir and said module flange;

wherein said vertically-compressible attachment means is offset from said accessory component whereby when said modular flange is translated toward said reservoir into an installed position, at least a portion of said accessory component intersects a plane defined by said upper surface of said reservoir without interfering with said reservoir.

* * * * *